US006038740A

United States Patent [19]

Hoger et al.

[11] Patent Number: 6,038,740

[45] Date of Patent: Mar. 21, 2000

[54] SCREWED CONNECTION OF A VEHICLE HINGE BRACKET

[75] Inventors: Heinz Hoger, Nufringen; Andreas Rath, Kusterdingen, both of Germany

[73] Assignee: DaimlerChrysler, Stuggart, Germany

[21] Appl. No.: 09/064,758

[22] Filed: Apr. 23, 1998

[30] Foreign Application Priority Data

Apr. 23, 1997 [DE] Germany ..... 197 17 027

[51] Int. Cl.[7] ..... E05D 5/00

[52] U.S. Cl. ..... 16/382; 16/235; 16/248; 411/84; 296/146.9; 296/29

[58] Field of Search ..... 16/382, 235, 240, 16/248, 249, DIG. 40, DIG. 43; 411/84; 296/146.9, 146.11, 29, 71, 76, 202

[56] References Cited

U.S. PATENT DOCUMENTS

| | | | |
|---|---|---|---|
| 4,304,027 | 12/1981 | Di Fazio | 16/249 |
| 4,982,475 | 1/1991 | Killingstad | 16/257 |
| 5,095,582 | 3/1992 | Ohlsson | 16/235 |
| 5,676,510 | 10/1997 | Fischer et al. | 411/84 |
| 5,787,550 | 8/1998 | Bender | 16/382 |
| 5,909,920 | 6/1999 | Dalinkiewicz | 411/84 |

FOREIGN PATENT DOCUMENTS

| | | |
|---|---|---|
| 87 16 621 | 3/1988 | Germany . |
| 40 34 599 A1 | 2/1992 | Germany . |

*Primary Examiner*—Chuck Y. Mah
*Attorney, Agent, or Firm*—Evenson McKeown Edwards & Lenahan P.L.L.C.

[57] ABSTRACT

After a release, a screwed connection of a hinge bracket for a vehicle door is to be returned into a precisely preadjusted condition. For this purpose, an alignable thread plate is fixed by an additional fixing screw in an adjusted position in the part to which the hinge bracket is to be screwed. As a result, a released screwed connection of a hinge flange is restored in a simple and secure manner.

6 Claims, 2 Drawing Sheets

SCREWED CONNECTION OF A VEHICLE HINGE BRACKET

BACKGROUND AND SUMMARY OF THE INVENTION

This application claims the priority of German application 197 17 027.7, filed Apr. 23, 1997, the disclosure of which is expressly incorporated by reference herein.

The present invention relates to a screwed connection of a hinge bracket for vehicle doors, and more particularly, to a screwed connection for vehicle doors, in which each hinge bracket is screwed by at least two screws to the wall of a door or of a door transom which, on the interior side, carries one alignable thread plate respectively which has tapped holes corresponding to the number and position of the screws. The screw passage openings provided in the wall of the door or of the door transom are dimensioned by a certain adjusting extent of the door with respect to the pertaining vehicle body cutout larger than the diameter of the fastening screws, in the adjusting position found after a proper door adjustment independently of the hinge holding screws. The thread plates are each fixable by at least one separate fixing screw, on the wall of the door of the door transom, and the pertaining screw passage hole/holes for the fastening also is/are larger by the above-mentioned adjusting measurement than the diameter of the corresponding holding screw(s).

DE 87 16 621 U1 shows a hinge fastening in which doors which had been removed after an adjustment can be mounted again without another adjustment.

The present invention solves the problem of providing a lasting adjustment in a known construction which can be produced in a more efficient manner. For achieving this object, the present invention provides construction wherein at least one of the barrels of the holding screws per hinge bracket in the area which, when the screwed connection is tightened, is situated inside the hinge bracket, has a larger diameter than the thread and is constructed in this area as a fitted screw. The fit diameter of the fastening screws with the slide-fit quality is matched with the correspondingly precisely manufactured screw passage hole in the hinge bracket.

In contrast to the previously known construction, the present invention has the advantage that no additional fitted bore has to be provided for a lasting adjustment. The door bracket is also constructed to save more material because no area of material must be provided for an additional fitted bore.

Insertion funnels are used in the present invention as mounting and remounting aids for the hinge holding screws in the threaded bores of the thread plate.

Insertion funnels are used in the present invention as mounting and remounting aids for the hinge holding screws in the threaded bores of the thread plate.

An efficient remounting of removed doors is achieved so that when the hinges are dismounted, the hinge holding screws cannot fall out of the hinge. This has been achieved by securing the holding screws with respect to falling out of the hinge bracket by way of a locking retaining washer. This locking retaining washer may, in particular, be made of an elastic material and thus obtain a slide-resistant securing position by being slid on in the expanded position.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

Holding screws 2 fasten a hinge bracket 1 to the wall 3 of a vehicle door by being screwed into a thread plate 4 resting against the interior of the wall 3. Before the holding screws 2 are tightened, the thread plate 4 rests loosely and therefore slidably with respect to it on the wall 3 of the door.

Figure 1:
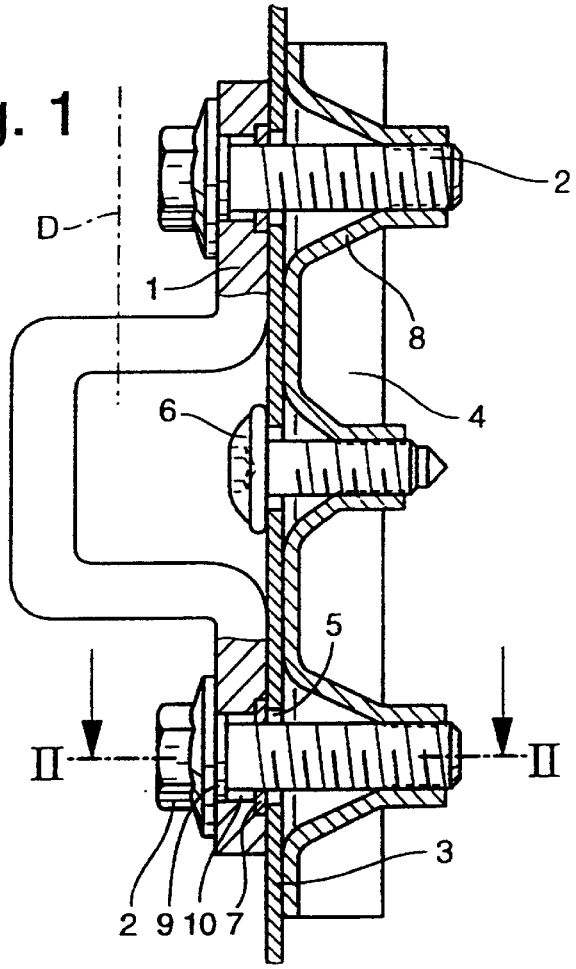
FIG. 1 is a cross-sectional view of a door bracket screwed to the wall of a vehicle door by a thread plate.
Figure 2:
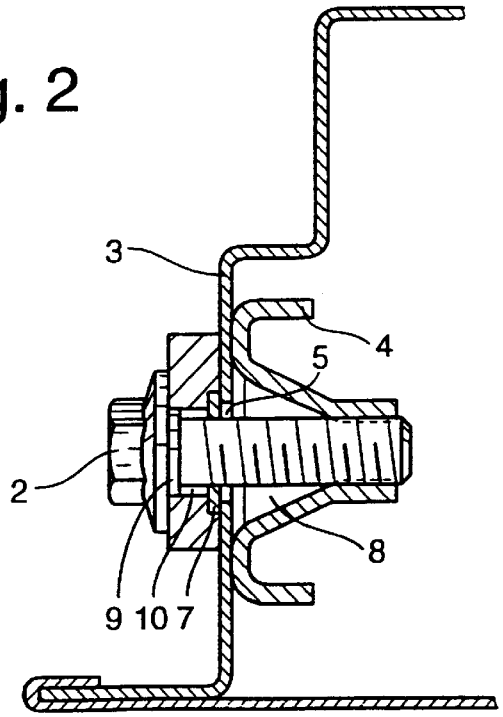
FIG. 2 is a cross-sectional view of the screwed-on door bracket along line II—II in FIG. 1.
Figure 3:
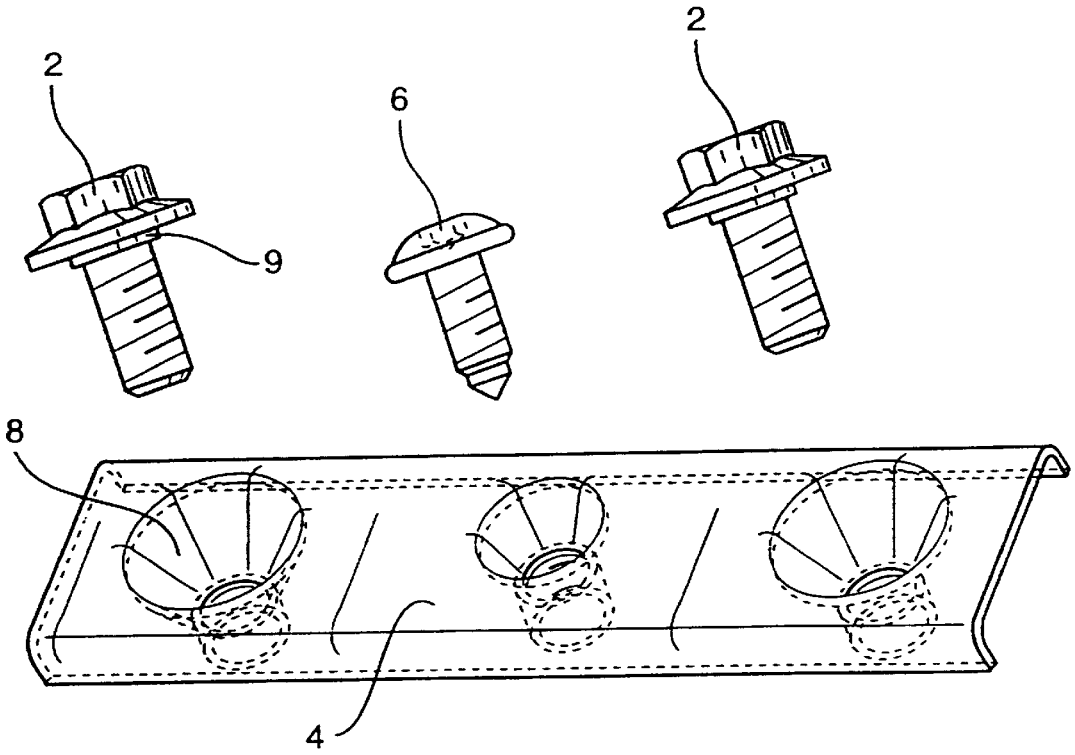
FIG. 3 is a perspective, exploded view of the thread plate with assigned screws of the door bracket shown in FIGS. 1 and 2.

In FIG. 1, the screw passage holes 5 are oblong holes which have the same direction in the wall 3 so that the hinge bracket 1 can slide only in one direction, specifically here horizontally.

If the hinge bracket 1 is adjusted on the wall 3 of the door a first time during a door mounting and if the holding screws 2 are firmly tightened in this condition, the corresponding position of the thread plate 4 is secured by a fixing screw 6. The fixing screw 6, which engages in a thread of a thread plate 4, holds the adjusted position of the thread plate 4 on the wall 3 of the door in the event that the holding screws 2 are released. The holding force of the fixing screw 6 is dimensioned such that, in the event of a remounting of a door on the removed hinge bracket 1, the thread plate 4 remains securely in its adjusted position.

In the illustrated embodiment, the hinge bracket 1 is the movable part of a hinge fastened to a door transom. The movement of the hinge bracket 1 takes place about the axis of rotation D (dot-dash lines) in which the hinge bracket 1 rotates with respect to the stationary part of the door hinge.

If a door, which had been screwed to a body structure during the vehicle production, is taken off again after the painting of the vehicle body, the separation takes place by the holding screws 2, and the hinge bracket 1 connected with the stationary hinge part remains on the vehicle body part. When the door is screwed on again, only the hinge is brackets 1 must again be screwed into the already adjusted thread plate 4 by way of the holding screws 2.

So that the adjusted position can be reached again in a precise manner, at least one of the holding screws 2 must be guided in a precisely fitting manner in a pertaining screw passage hole 10 of the hinge bracket 1 if, as in the illustrated case, only a precise adjustment is important in a direction defined by the oblong hole shapes of the screw passage holes 5. In order to obtain the required precise fit of a holding screw 2 in a screw passage hole 10; the thread of the holding screw 2 must have a slightly smaller diameter than the barrel area 9 of this fitting screw 2. To prevent the holding screws 2 from falling out of this door when the hinge bracket 1 is dismounted from the door, the holding screws 2 are each axially fixed, so that they cannot be lost, by a locking retaining washer 7 which consists of an elastic material and is screw on in a slide-resistant manner.

The tapped holes for the holding screws 2 within the thread plate 4 are situated in screw inserting areas 8 of the thread plate which are funnel-shaped. These funnel-shaped inserting areas 8 permit an easy centering of the holding screws 2 when the hinge bracket 1 is mounted also when it is placed slightly inaccurately, which thereby contributes to an efficient mounting.

The foregoing disclosure has been set forth merely to illustrate the invention and is not intended to be limiting.

Since modifications of the disclosed embodiments incorporating the spirit and substance of the invention may occur to persons skilled in the art, the invention should be construed to include everything within the scope of the appended claims and equivalents thereof.

What is claimed is:

1. A screwed hinge bracket connection for a vehicle door, comprising a hinge bracket, at least two fastening screws screwing the hinge bracket to a wall, at least one alignable thread plate being carryable on an interior side of the wall and having tapped holes corresponding to the number and position of the at least two fastening screws, screw passage openings being provided in the wall and being dimensioned, to provide an amount of a predetermined adjustment of the wall with respect to an associated vehicle body cutout, larger than a diameter of the at least two fastening screws, in an adjusting position determined after a proper door adjustment independent of the at least two fastening screws, and at least one fixing screw for fixing the at least one alignable thread plate on the wall and having at least one passage hole in the wall sized to be larger than the diameter of the at least one fixing screw by the predetermined adjustment amount, wherein at least one barrel portion of the at least two fastening screws is situated inside the hinge bracket and has a diameter larger than a thread portion so as to be configured as a fitted screw, the diameter of the at least one barrel portion being sized to correspond to a precisely manufactured screw passage hole in the hinge bracket.

2. The screwed connection according to claim 1, wherein the tapped holes provided for the screws in the thread plate are countersunk in a funnel-shape on a screw inserting side of the plate.

3. The screwed connection according to claim 2, wherein the thread plate is a profiled metal sheet, and the funnel-shaped threaded holes are extruded holes.

4. The screwed connection according to claim 1, wherein the screws are secured, after insertion into the associated hinge bracket, by an elastically widened locking retaining washer winding around a screw barrel of the screws.

5. The screwed connection according to claim 4, wherein the washers are plastic.

6. The screwed connection according to claim 4, wherein the tapped holes provided for the screws in the thread plate are countersunk in a funnel-shape on a screw inserting side of the plate.

* * * * *